US006049049A

United States Patent [19]

Lindberg

[11] Patent Number: 6,049,049

[45] Date of Patent: Apr. 11, 2000

[54] SURGE ARRESTER

[75] Inventor: Björn Lindberg, Ludvika, Sweden

[73] Assignee: ABB AB, Vasteras, Sweden

[21] Appl. No.: 09/125,510

[22] PCT Filed: Jan. 29, 1997

[86] PCT No.: PCT/SE97/00140

§ 371 Date: Nov. 2, 1998

§ 102(e) Date: Nov. 2, 1998

[87] PCT Pub. No.: WO97/31380

PCT Pub. Date: Aug. 28, 1997

[30] Foreign Application Priority Data

Feb. 21, 1996 [SE] Sweden ..... 9600641

[51] Int. Cl.[7] ..... H01H 33/16

[52] U.S. Cl. ..... 218/143; 218/7; 361/117

[58] Field of Search ..... 218/7, 14, 45, 218/84, 67, 73, 155–6, 154; 248/20, 21, 22, 258 R; 361/117, 118, 119

[56] References Cited

U.S. PATENT DOCUMENTS 3,586,913 6/1971 Olsen ..... 218/14

3,856,242 12/1974 Cook .

5,444,429 8/1995 Sakich et al. ..... 338/21

OTHER PUBLICATIONS

Swedish–American UHV Test Station, p. 67/Svenek–amerikanek provningestation för ultrahöga–spänningar, p. 19, ASEA Journal 1977, vol. 1 (no month).

WO 96/07186 7/1996 WIPO Surge Arrester.

*Primary Examiner*—Lincoln Donovan

*Attorney, Agent, or Firm*—Pollock, Vande Sande & Amernick

[57] ABSTRACT

A surge arrester for high system voltages is provided. The arrester comprises an elongated column composed of a plurality of coaxially arranged valve units. The column is mechanically divided into an upper and a lower column part, and the two column parts are interconnected via a moment-limiting articulated member. The articulated member has an upper bearing plate with a concave sliding surface, which makes contact with a convex sliding surface of a lower bearing plate. The upper bearing plate is connected to the grounded stand of the arrester via tensionally prestressed, insulating links. The articulated member comprises a number of springs, adapted to the stiffness of the lower column part, to keep the two bearing plates correctly positioned relative to each other in the transversal direction.

9 Claims, 1 Drawing Sheet

SURGE ARRESTER

TECHNICAL FIELD

The present invention relates to a surge arrester comprising an elongated column composed of a number of coaxially arranged valve units, each comprising a stack of a plurality of cylindrical varistor blocks which are arranged one after the other in the axial direction of the varistor blocks between two end electrodes and surrounded by an elongated, electrically insulating outer housing.

The invention is primarily intended for use in surge arresters for relatively high system voltages, for example 420 kV and higher, but it can also be used in arresters for lower voltages.

BACKGROUND ART

Surge arresters for voltages of the of the above-mentioned order of magnitude can be subjected to high mechanical stresses, for example due to wind load and earthquake.

It is known to design surge arresters for high system voltages with a lower part comprising three vertically arranged insulator columns, which are mounted at the bottom on a metal stand intended for ground connection to form, in cross section, an equilateral triangular configuration. The lower part supports a centrally placed upper insulator column, which at the top is provided with an end armature intended for high-voltage connection. Each insulator column is composed of a plurality of coaxially arranged hollow insulators of porcelain. The upper insulator column and one of the insulator columns in the lower part comprise varistor blocks, whereas the other two insulator columns in the lower part are empty and only have a mechanical function. Such an arrester, designed for system voltages of 1600 kV, is shown in Asea Journal 1977, vol. 1, p. 19. This arrester has a height of 13 meters. Such a design is very costly and, in addition, cannot be used without taking special measures if the housings of the valve units are made of polymer material instead of porcelain, because these materials have completely different mechanical properties.

SUMMARY OF THE INVENTION

The present invention aims to provide a surge arrester which is considerably less expensive than comparable prior art designs and which, in addition, is more resistant to mechanical stresses which may arise due to external influence, for example in case of an earthquake.

According to the invention, the stack of surge arresters is mechanically divided into an upper and a lower column part, and the two column parts are connected to each other via a moment-limiting articulated member. The articulated member is made with an upper bearing plate which has a concave sliding surface, which makes contact with a convex sliding surface of a lower bearing plate. The upper bearing plate is connected to the grounded stand of the arrester by means of tensionally prestressed, insulated links. The articulated member includes a spring system adapted to the stiffness of the lower column part to maintain the two bearing plates (and hence the end portions of the two column parts interconnected by the articulated member) positioned correctly relative to each other in the transversal direction.

The shape of the sliding surfaces of the bearing plates is determined by the deflection profile of the arrester column, and, the surfaces exhibit a larger angular change (less radius of curvature) at the periphery than at the center. In such a design, the insulated links take up a larger force relative to the arrester column and this difference increases with the deflection. In this way, the arrester may also withstand very high static and dynamic loads.

BRIEF DESCRIPTION OF THE DRAWINGS

The invention will be explained in greater detail by description of embodiments with reference to the accompanying drawings, wherein.

DESCRIPTION OF THE PREFERRED EMBODIMENTS

Figure 1:
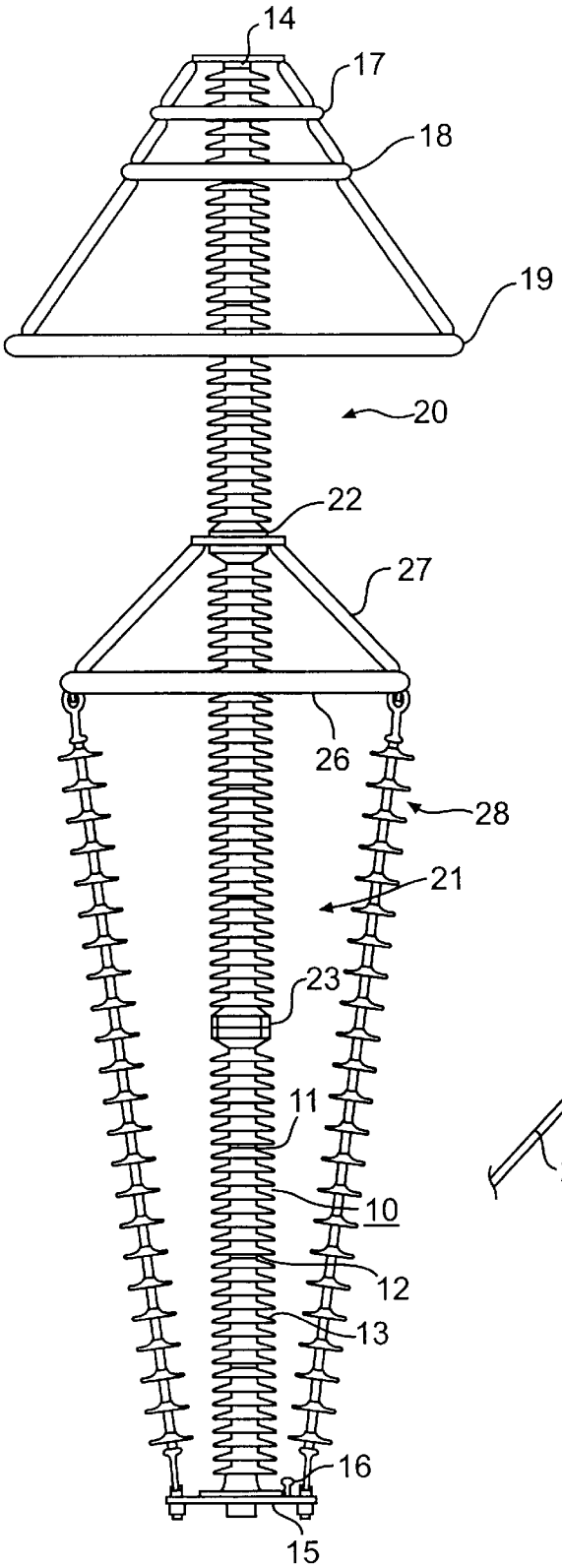
FIG. 1 shows in a side view one embodiment of a surge arrester designed according to the invention.

The surge arrester shown in FIG. 1 is intended for a system voltage of 550 kV and has a height of 5 m. The arrester has the shape of an elongated column composed of twelve coaxially arranged valve units 10. Each such valve unit comprises a stack of a number of cylindrical varistor blocks which are arranged one after the other in the axial direction of the varistor blocks between two end electrodes 11, 12 and surrounded by an electrically insulating outer housing 13, for example as shown in Swedish patent application 9402745-5. The arrester is provided with an upper end armature 14, intended to be connected to a high-voltage conductor, and a lower end armature 15 provided with a terminal 16 for a grounding conductor. The upper end armature 14 supports three shield rings 17, 18, 19.

The arrester is mechanically divided into an upper column part 20, comprising the four uppermost valve units, and a lower column 21 comprising the eight lowermost valve units. The two column parts 20, 21 are connected to each other via an articulated member 22. For reasons of mounting, the lower column part is composed of two mounting units, each of which comprising four valve units 10 and being secured to each other via an intermediate flange 23.

Figure 2:
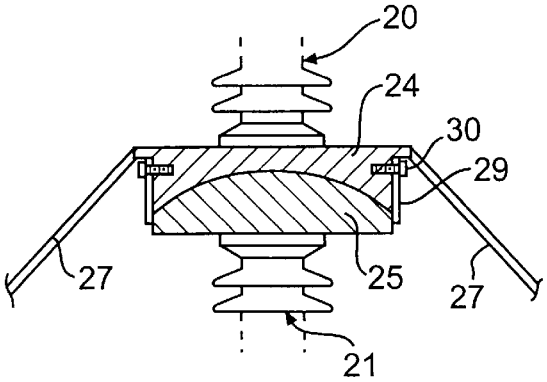
FIG. 2 shows in axial section a moment-limiting articulated member included in the surge arrester according to FIG. 1.

The articulated member 22 (FIG. 2) comprises an upper bearing plate 24 fixed to the lower end portion of the upper column part 20, and a lower bearing plate 25 fixed to the upper end portion of the lower column part 21. The upper bearing plate 24 has a concave sliding surface which makes contact with a convex sliding surface of the lower bearing plate 25. The geometry (the variation of the radius of curvature from the center of the surfaces towards the periphery) of the sliding surfaces is determined by the deflection profile of the column parts.

The upper bearing plate 24 supports a shield ring 26 which is secured to the upper bearing plate with the aid of three supporting bars 27 which are fixed, angularly displaced, at even mutual distances around the periphery of the plate. From the points of attachment of the supporting bars 27 in the shield ring 26 there extend three electrically insulated, tensionally prestressed links 28, which, at the lower part, are fixed to the lower end armature of the arrester. In the example shown, the links 28 are in the form of suspension insulators of polymer material.

To keep the upper end of the lower column part in a correct position relative to the upper column part, the articulated member 22 is provided with a spring system, comprising a number of leaf springs 29 fixed to the periphery of the upper bearing plate and extending down over the peripheral surface of the lower bearing plate 25. The leaf springs 29 may be made from a flat bar of spring steel, the characteristic of which is adapted to the stiffness of the lower column part. The leaf springs are fixed to the upper bearing plate by means of mounting bolts 30.

One of the sliding surfaces of the two bearing plates may be provided with a friction-reducing coating of, for example, polytetrafluoro ethylene.

The electrical connection between the upper and lower column parts is achieved with the aid of a flexible conductor bridging the articulated member 22.

The invention is not limited to the embodiment shown but a plurality of modifications are feasible within the scope of the claims. For example, each of the insulating links 28 may be attached to the lower end armature 15 via a separate tensions spring to achieve the required tensile prestress.

I claim:

1. A surge arrester comprising an elongated column composed of a number of coaxially arranged valve units, each of which comprising a stack of a number of cylindrical varistor blocks which are arranged one after the other in the axial direction of the varistor blocks between two end electrodes and surrounded by an elongated, electrically insulating outer housing, the arrester being provided with an upper end armature designed for high-voltage connection, and a lower end armature designed for ground connection, the column comprise an upper column part and a lower column part, which column parts are interconnected via a moment-limiting articulated member which is arranged such that the column parts are swayably movable relative to each other.

2. A surge arrester according to claim 1, wherein the articulated member comprises an upper bearing plate fixed to a lower end portion of the upper column part, and a lower bearing plate fixed to an upper end portion of the lower column part, that the upper bearing plate has a concave sliding surface which makes contact with a convex sliding surface of the lower bearing plate, and that the upper bearing plate is connected to the lower end armature of the arrester via moment-transmitting, insulating links.

3. A surge arrester according to claim 2, wherein the articulated member comprises a spring system, adapted to the stiffness of the lower column part, for positioning the lower column part.

4. A surge arrester according to claim 3, wherein the spring system comprises a number of leaf springs fixed to a periphery of the upper bearing plate and which extends down over a peripheral surface of the lower bearing plate.

5. A surge arrester according to claim 2, wherein the upper bearing plate supports a shield ring, and the insulating links extend between the shield ring and the lower end armature of the arrester.

6. A surge arrester according to claim 2, wherein the insulating links are in the form of suspension insulators of polymer material.

7. A surge arrester according to claim 2, wherein the insulating links are tensionally prestressed.

8. A surge arrester according to claim 7, wherein each of the insulating links is connected in series with a tension spring.

9. A surge arrester according to claim 1, wherein the housings of the valve units are made of rubber or other polymeric material.

* * * * *